US008596099B1

(12) United States Patent
Eldred

(10) Patent No.: US 8,596,099 B1
(45) Date of Patent: Dec. 3, 2013

(54) HVAC THEFT DETERRENT APPARATUS AND METHOD

(71) Applicant: HVAC Shackle LLC, Monroe, NC (US)

(72) Inventor: Donald L. Eldred, Monroe, NC (US)

(73) Assignee: HVAC Shackle LLC, Monroe, NC (US)

( * ) Notice: Subject to any disclaimer, the term of this patent is extended or adjusted under 35 U.S.C. 154(b) by 0 days.

(21) Appl. No.: 13/667,073

(22) Filed: Nov. 2, 2012

(51) Int. Cl.
*E05B 73/00* (2006.01)

(52) U.S. Cl.
USPC ..... 70/18; 70/14; 70/49; 70/58

(58) Field of Classification Search
USPC ..... 70/14, 18, 30, 49, 158, 163–173, 58, 70/59, 233; 248/551–553
See application file for complete search history.

(56) References Cited

U.S. PATENT DOCUMENTS

| | | | | | |
|---|---|---|---|---|---|
| 1,279,394 | A | * | 9/1918 | Mazon et al. | 70/15 |
| 1,401,971 | A | * | 1/1922 | Faison | 70/15 |
| 2,791,898 | A | * | 5/1957 | Pegg et al. | 70/230 |
| 3,537,548 | A | * | 11/1970 | Jeppesen | 188/32 |
| 3,752,254 | A | * | 8/1973 | Carley et al. | 180/68.5 |
| 3,762,191 | A | * | 10/1973 | Smith | 70/18 |
| 3,831,407 | A | * | 8/1974 | Coleman | 2/421 |
| 3,845,643 | A | * | 11/1974 | Barrett | 70/18 |
| 4,024,738 | A | * | 5/1977 | Pi | 70/59 |
| 4,079,872 | A | * | 3/1978 | Halter | 224/418 |
| 4,157,602 | A | * | 6/1979 | Pennell | 24/370 |
| 4,249,403 | A | * | 2/1981 | Littlejohn | 70/230 |
| 4,556,187 | A | * | 12/1985 | McLin | 248/503 |
| 4,817,401 | A | * | 4/1989 | Cohodar | 70/58 |
| 5,135,197 | A | * | 8/1992 | Kelley et al. | 248/551 |
| 5,531,364 | A | * | 7/1996 | Buis | 224/413 |
| 5,613,385 | A | * | 3/1997 | Yamabe | 70/226 |
| 5,642,634 | A | * | 7/1997 | Perry | 70/18 |
| 5,709,110 | A | * | 1/1998 | Greenfield et al. | 70/58 |
| 5,794,464 | A | * | 8/1998 | Yeager et al. | 70/57 |
| 6,237,375 | B1 | * | 5/2001 | Wymer | 70/14 |
| 6,308,928 | B1 | * | 10/2001 | Galant | 248/553 |
| 6,827,169 | B1 | * | 12/2004 | Van Hout et al. | 180/68.5 |
| 7,812,734 | B2 | | 10/2010 | Hardin | |
| 7,819,151 | B1 | | 10/2010 | Kuhn | |
| 8,130,100 | B2 | | 3/2012 | Barger | |
| 2003/0201892 | A1 | | 10/2003 | Chance et al. | |
| 2012/0126971 | A1 | | 5/2012 | Robinson, Jr. | |

* cited by examiner

*Primary Examiner* — Suzanne Barrett
(74) *Attorney, Agent, or Firm* — Shumaker, Loop & Kendrick, LLP

(57) ABSTRACT

An apparatus for deterring theft of an outdoor-type HVAC condenser unit that includes a first cut-resistant, elongate restraint for being extended across a top and down opposing sides of the unit, and includes on opposite ends thereof a respective anchor for being secured in a supporting structure on which the unit is positioned. A second cut-resistant, elongate restraint is provided for being extended across the top and down opposing sides of the unit in spaced-apart relation to and intersecting the first restraint, and includes on opposite ends thereof a respective anchor for being secured in the supporting structure on which the unit is positioned. At least one lock is provided for connecting together the first restraint and the second restraint at a point of intersecting the first restraint and the second restraint.

14 Claims, 3 Drawing Sheets

HVAC THEFT DETERRENT APPARATUS AND METHOD

TECHNICAL FIELD AND BACKGROUND OF THE INVENTION

The present invention relates to an apparatus and method for deterring theft of outdoor heating, ventilating and air conditioning ("HVAC") units. Such outdoor units are often but not always "condenser" or "compressor" units. As described in this application, the unit to be protected is referred to as a "condenser" but may be any unit that is either outdoors or in some other exposed or unprotected location where it can be stolen.

An HVAC system operations on a refrigeration cycle. The refrigeration cycle uses four essential elements to create a cooling effect. The system refrigerant starts its cycle in a gaseous state. The compressor pumps the refrigerant gas up to a high pressure and temperature. From there it enters a heat exchanger (sometimes called a "condensing coil" or condenser) where it loses energy (heat) to the outside. In the process the refrigerant condenses into a liquid. The liquid refrigerant is returned indoors to another heat exchanger ("evaporating coil" or evaporator). A metering device allows the liquid to flow in at a low pressure at the proper rate. As the liquid refrigerant evaporates it absorbs energy (heat) from the inside air, returns to the compressor, and repeats the cycle. In the process heat is absorbed from indoors and transferred outdoors, resulting in cooling of the building.

In variable climates, the system may include a reversing valve that automatically switches from heating in winter to cooling in summer. By reversing the flow of refrigerant, the heat pump refrigeration cycle is changed from cooling to heating or vice versa. This allows a residence or facility to be heated and cooled by a single piece of equipment, by the same means, with the same hardware. Central, 'all-air' air conditioning systems (or package systems) with a combined outdoor condenser/evaporator unit are sometimes installed in modern residences, offices, and public buildings. The condenser unit of the HVAC system is typically a cylindrical, square or rectangular metal cabinet within which are positioned copper condensing coils through which refrigerant is passed. A fan positioned above the condensing coils draws air over the coils, removing heat from the refrigerant passing through the coils, as described above. Since, during an air conditioning cycle heat is removed from the refrigerant, the condenser unit is typically placed outside the building on a concrete base.

Because of the high salvage value of copper, theft of outdoor units such as condenser units has become a serious problem, particularly for churches and office building that may have a number of condensers placed next to each other outside the building. Ordinarily, it is a simple matter to quickly cut the electrical wiring and refrigerant hoses that connect the condenser to the interior HVAC units, lift the condensers off of their bases, put them in a vehicle and drive off. In many instances, thieves use trucks that resemble repair trucks and wear clothing that resembles clothing that a repairman would wear. Often, it takes only several minutes to steal several condensers and leave the vicinity. Then, the thieves remove the copper condensing coils to sell for scrap, and discard the remaining components.

Prior art theft deterrent devices are typically either alarms that detect removal of the unit, which may be combined with some form of wire cage that is place over the condenser but which is easily removed. Alarms are generally ineffective due to the speed with which condensers can be stolen and removed from the vicinity of the theft—much faster than police can normally respond to such an alarm. Prior art publications include U.S. Pat. No. 8,130,100; U.S. Publication No. 2003/0201892; U.S. Pat. No. 7,819,151; U.S. Pat. No. 7,812,734; and U.S.

Therefore, it is an object of the invention to provide an apparatus for deterring theft of HVAC and similar outdoor units;

It is another object of the invention to provide a method for deterring theft of HVAC and similar outdoor units;

It is yet another object of the invention to provide an apparatus and method for deterring theft of HVAC and similar outdoor units, that are inexpensive, easy to install and does not require an alarm to be fully functional.

These and other objects and advantages of the invention are achieved by providing an apparatus for deterring theft of an outdoor-type HVAC condenser unit that includes a first cut-resistant, elongate restraint for being extended across a top and down opposing sides of the unit, and includes on opposite ends thereof a respective anchor for being secured in a supporting structure on which the unit is positioned. A second cut-resistant, elongate restraint is provided for being extended across the top and down opposing sides of the unit in spaced-apart relation to and intersecting the first restraint, and includes on opposite ends thereof a respective anchor for being secured in the supporting structure on which the unit is positioned. At least one lock is provided for connecting together the first restraint and the second restraint at a point of intersection of the first restraint and the second restraint.

According to one embodiment of the invention, the first restraint and the second restraint are each link chains.

According to another embodiment of the invention, the restraints are each link chains, the anchors comprise a length of rebar for being driven into the ground adjacent the unit, and the lock comprises a padlock.

According to another embodiment of the invention, the first restraint and second restraints each include a protective covering.

According to another embodiment of the invention, the first restraint and second restraints each comprise a link chain, and a plastic sleeve positioned on the restraint.

According to another embodiment of the invention, an apparatus for deterring theft of an outdoor-type HVAC condenser unit is provided that includes a first cut-resistant, elongate restraint for being extended across a top and down opposing sides of the unit, and includes on opposite ends thereof a respective anchor for being secured in a supporting structure on which the unit is positioned. A second cut-resistant, elongate restraint is provided for being extended across the top and down opposing sides of the unit in spaced-apart relation to and intersects the first restraint, and includes on opposite ends thereof a respective anchor for being secured in the supporting structure on which the unit is positioned. A third cut-resistant, elongate restraint is provided for being extended across the top and down opposing sides of the unit in spaced-apart relation to and intersects the first restraint, in spaced-apart relation and parallel to the second restraint, and includes on opposite ends thereof a respective anchor for being secured in the supporting structure on which the unit is positioned. At least one lock is provided for connecting together the first restraint and second restraint at a point of intersection of the first restraint and the second restraint.

According to another embodiment of the invention, the first restraint is adapted to intersect the second and third restraints in spaced-apart relation to each other on the top of the unit, and further wherein the first restraint is adapted to the connected to the second and third restraints at respective points of intersection.

According to another embodiment of the invention, a method of deterring theft of an outdoor-type HVAC condenser unit is provided, and comprises the steps of providing a first cut-resistant, elongate restraint for being extended across a top and down opposing sides of the unit, and includes on opposite ends thereof a respective anchor for being secured in a supporting structure on which the unit is positioned. A second cut-resistant, elongate restraint is provided for being extended across the top and down opposing sides of the unit in spaced-apart relation to and intersecting the first restraint, and including on opposite ends thereof a respective anchor for being secured in the supporting structure on which the unit is positioned. At least one lock is provided for connecting together the first restraint and the second restraint at a point of intersection of the first restraint and the second restraint. The first restraint is extended across the top and down opposing sides of the unit. The second restraint is extended across the top and down opposing sides of the unit and intersects the first restraint. An anchor condition is formed in the supporting structure for each end of the first and second restraints, and each end of the first and second restraints are secured to the supporting surface. The first restraint and second restraint are connected together at a point of intersection.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DETAILED DESCRIPTION OF A PREFERRED EMBODIMENT AND BEST MODE

Figure 1:
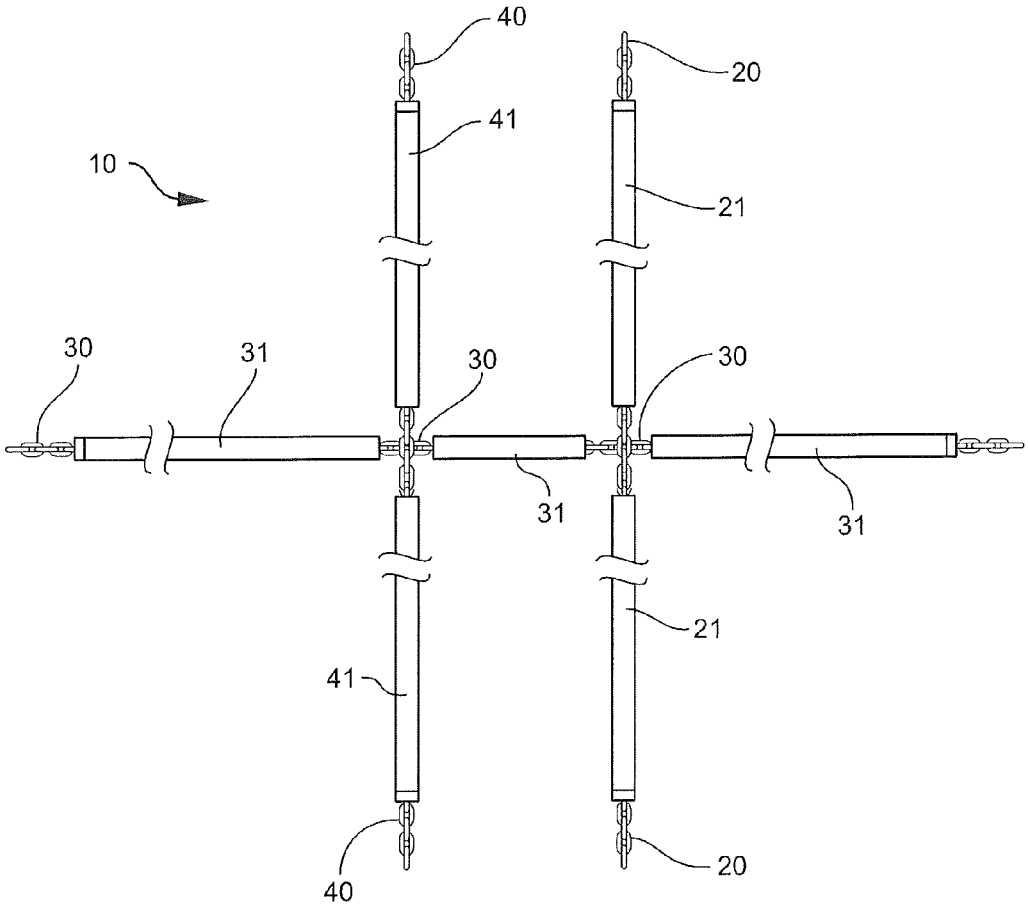
FIG. 1 is a plan view of an array of chain elements of the apparatus in a configuration for installation on an HVAC unit.
Figure 2:
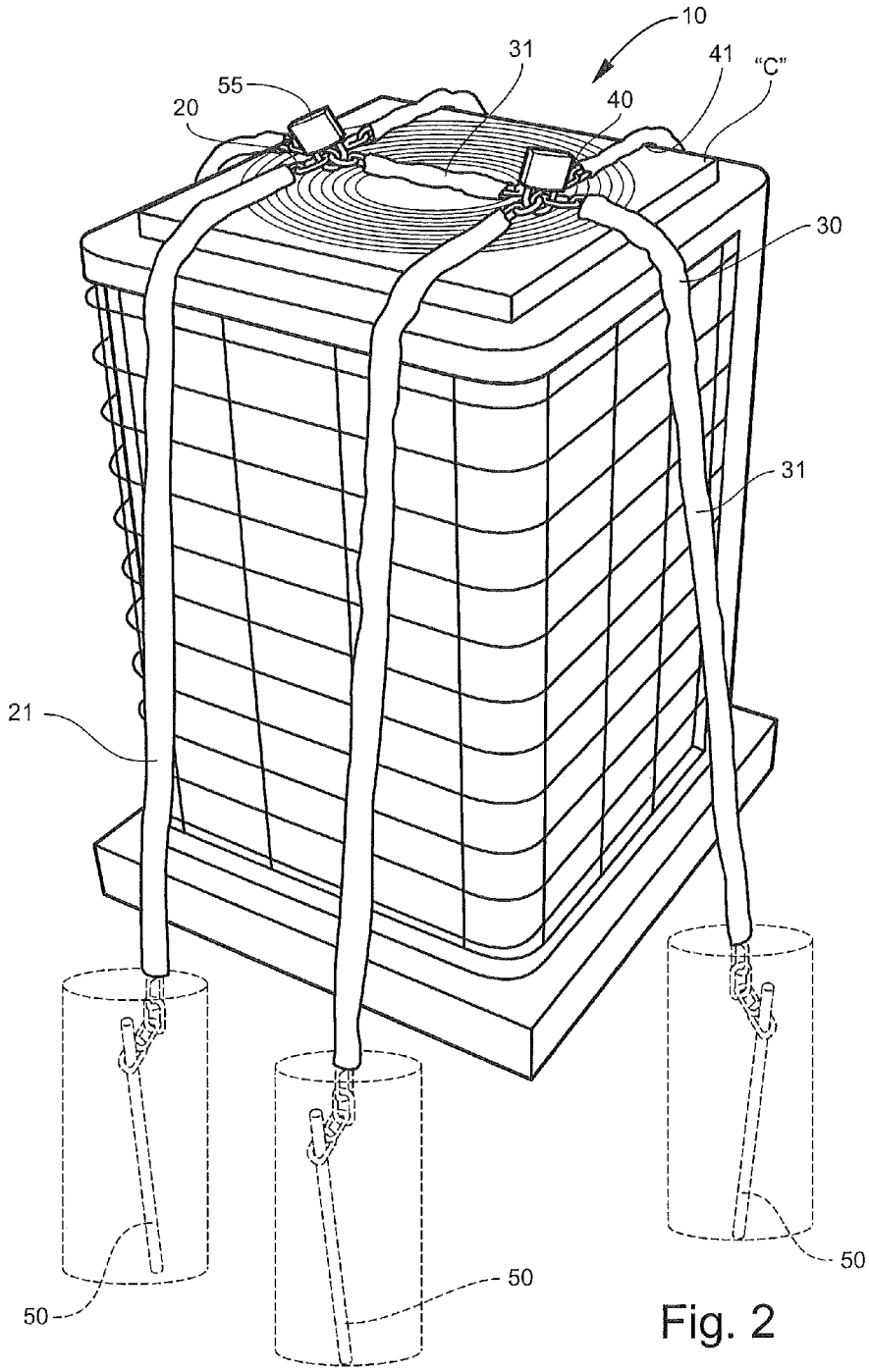
FIG. 2 is a perspective view of an HVAC unit with the apparatus according to one preferred embodiment of the invention in place.
Figure 3:
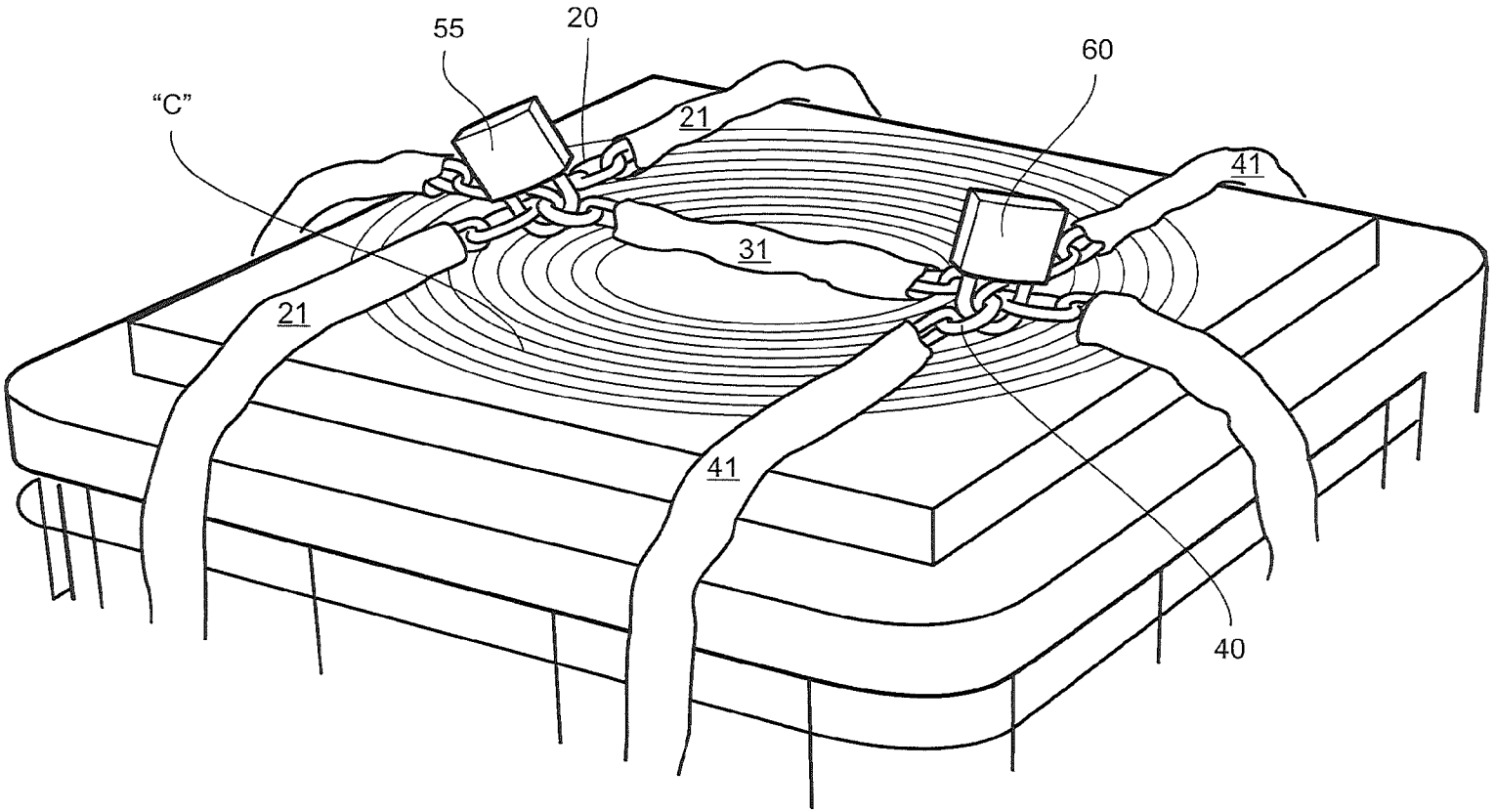
FIG. 3 is an enlarged view of the apparatus according to one preferred embodiment of the invention in place, showing interconnection of chain elements of the invention.

Referring now to the drawings, an apparatus 10 for deterring theft of an HVAC unit, such as a condenser unit "C" is shown in FIGS. 1, 2 and 3. Apparatus 10 includes first, second and third elongate restraints. According to one preferred embodiment of the invention, the restraints are formed of hardened steel link chains 20, 30 and 40 and are each covered with protective plastic sleeves 21, 31 and 41, respectively. Anchors, for example, lengths of steel rebar 50, are driven through a link near the ends of the chains 20, 30 and 40. Holes are dug in the ground where the chains 20, 30, and 40 extend, and the rebar anchor 50 is driven into the ground on which the unit "C" is positioned. Then, cement is placed in the hole, anchoring the rebar anchors 50 and the attached chains 20, 30 and 40 to the ground.

To prevent the chains 20, 30, and 40 from being pulled to the side in an effort to remove the unit "C", they are connected together at respective points of intersection. As shown in FIGS. 1, 2 and 3, heavy-duty padlocks 55 and 60 are used to lock the chain 30 to the chains 20 and 40. The resulting "H" shape, as best shown in FIG. 1, is very effective in preventing displacement of the chains 20, 30 and 40 from their respective positions.

One preferred embodiment of the apparatus 10 is further described below by way of example:

Chains 20, 30 and 40—10 foot long Grade 70, yellow zinc 5/16 inch, which a working load of 4700 lbs.

Sleeves 21, 31, 41—8 foot long economy discharge hose.

Locks 55, 60—Rust proof, Dual Armor Master Lock meeting maximum ASTM standards, keyed to be opened with a single key.

The chains 20, 30 and 40 are sized to be positioned close enough to the top and sides of the condenser unit "C" when locked as described above, but long enough to be moved aside when unlocked from each other to gain access to the condenser unit "C"

Alternative arrangements may include using only two intersection chains, or more than three as required for the size and shape of the condenser "C". Hardened steel cable may be used instead of chains for the restraints, in which case hardened steel loops would be welded to the ends of the cable and at the intersection points to receive the anchors and locks.

An apparatus and method for deterring theft of outdoor heating, ventilating and air conditioning ("HVAC") units are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An apparatus for deterring theft of an outdoor-type HVAC condenser unit:

(a) a first cut-resistant, elongate restraint for being extended across a top and down opposing sides of the unit, and including on opposite ends thereof a respective anchor for being secured in a supporting structure on which the unit is positioned;

(b) a second cut-resistant, elongate restraint for being extended across the top and down opposing sides of the unit in spaced-apart relation to and intersecting the first restraint, and including on opposite ends thereof a respective anchor for being secured in the supporting structure on which the unit is positioned;

(c) at least one lock for releasably securing the first restraint and the second restraint in position on the unit; and (d) wherein the first restraint and the second restraint are each link chains, the anchors comprise a length of rebar for being driven into the ground adjacent the unit, and the lock comprises a padlock.

2. An apparatus according to claim 1, wherein the first restraint and the second restraint are each link chains.

3. An apparatus according to claim 1, wherein the first restraint and second restraint each include a protective covering.

4. An apparatus according to claim 1, wherein the first restraint and second restraint each comprise a link chain, and a protective plastic sleeve positioned on the restraint.

5. An apparatus for deterring theft of an outdoor-type HVAC condenser unit:

(a) a first cut-resistant, elongate restraint for being extended across a top and down opposing sides of the unit, and including on opposite ends thereof a respective anchor for being secured in a supporting structure on which the unit is positioned;

(b) a second cut-resistant, elongate restraint for being extended across the top and down opposing sides of the unit in spaced-apart relation to and intersecting the first restraint, and including on opposite ends thereof a respective anchor for being secured in the supporting structure on which the unit is positioned;

(c) a third cut-resistant, elongate restraint for being extended across the top and down opposing sides of the unit in spaced-apart relation to and intersecting the first restraint, in spaced-apart relation and parallel to the second restraint, and including on opposite ends thereof a respective anchor for being secured in the supporting structure on which the unit is positioned; and (d) at least one lock for connecting together the first restraint, second restraint and third restraint at a point of intersection the first, second and third restraint.

6. An apparatus according to claim 5, wherein the first restraint, second restraint and third restraint are each link chains.

7. An apparatus according to claim 5, wherein the first restraint, the second restraint and the third restraint are each link chains, the anchors comprise a length of rebar for being driven into the ground adjacent the unit, and the lock comprises a padlock.

8. An apparatus according to claim 5, wherein the first restraint, the second restraint and the third restraint are each covered with a protective covering.

9. An apparatus according to claim 5, wherein the first restraint, the second restraint and the third restraint each comprise a link chain, and a protective plastic sleeve is positioned on each restraint.

10. An apparatus according to claim 5, wherein the first restraint is adapted to intersect the second and third restraints in spaced-apart relation to each other on the top of the unit, and further wherein the first restraint is adapted to be connected to the second and third restraints at respective points of intersection.

11. A method of deterring theft of an outdoor-type HVAC condenser unit, comprising the steps of providing:

(a) a first cut-resistant, elongate restraint comprising a link chain for being extended across a top and down opposing sides of the unit, and including on opposite ends thereof a respective anchor for being secured in a supporting structure on which the unit is positioned;

(b) a second cut-resistant, elongate restraint comprising a link chain for being extended across the top and down opposing sides of the unit in spaced-apart relation to and intersecting the first restraint, and including on opposite ends thereof a respective anchor for being secured in the supporting structure on which the unit is positioned;

(c) at least one lock for connecting together the first restraint and the second restraint at a point of intersection of the first restraint and the second restraint;

(d) extending the first restraint across the top and down opposing sides of the unit;

(e) extending the second restraint across the top and down opposing sides of the unit and intersecting the first restraint;

(f) forming an anchor condition in the supporting structure for each end of the first and second restraints, the step forming an anchor condition including the steps of forming a hole in the supporting surface for each restraint end, positioning the anchors in the holes, and placing cement in the holes to secure the anchors in the holes;

(g) anchoring each end of the first and second restraints to the supporting surface; and (h) connecting the first restraint and second restraint together at a point of intersection.

12. A method according to claim 11, wherein the first restraint and second restraint are each link chains.

13. A method according to claim 11, and including the step of providing the first restraint and the second restraint with a protective covering.

14. A method according to claim 11, and including the step of providing the first restraint and the second restraint with a plastic sleeve.

* * * * *